US005726403A

United States Patent [19]

Sondergeld et al.

[11] Patent Number: 5,726,403

[45] Date of Patent: Mar. 10, 1998

[54] SWITCH

[76] Inventors: Manfred Sondergeld, Glasbachweg 18; Dietmar Schwegler, Im Tal 27, both of D-78112 St. Georgen, Germany

[21] Appl. No.: 652,262

[22] Filed: May 23, 1996

[30] Foreign Application Priority Data

May 23, 1995 [DE] Germany ..... 195 18 824.1

[51] Int. Cl.[6] ..... H01H 35/14

[52] U.S. Cl. ..... 200/61.53

[58] Field of Search ..... 200/61.53, 61.45 R, 200/61.74, 61.71

[56] References Cited

U.S. PATENT DOCUMENTS

| | | | |
|---|---|---|---|
| 3,731,022 | 5/1973 | Loftus | 200/61.49 |
| 3,737,604 | 6/1973 | Dietrich et al. | 200/61.53 |
| 4,536,629 | 8/1985 | Diller | 200/61.45 R |
| 4,873,401 | 10/1989 | Ireland | 200/61.45 M |
| 4,929,808 | 5/1990 | Roeser | 200/467 |
| 5,212,358 | 5/1993 | Yoshimura et al. | 200/61.45 M |
| 5,533,588 | 7/1996 | Maiwald et al. | 180/282 |

FOREIGN PATENT DOCUMENTS 94 12 898.7 11/1994 Germany .

*Primary Examiner*—Adolf Berhane
*Attorney, Agent, or Firm*—Harness, Dickey & Pierce, P.L.C.

[57] ABSTRACT

A switch (10) with a mass (17) which moves along a path (32) between a home position and at least one switching position displaying at least a first reset element (18), which prestresses the mass (17) in its home position, and a switching contact (27) activated by the mass (17). The first reset element (18) comprises an actuating part (15) which actuates the switching contact(27) when the mass (17) moves against the force of the first reset element (18) from its home position towards its at least one switching position.

12 Claims, 1 Drawing Sheet

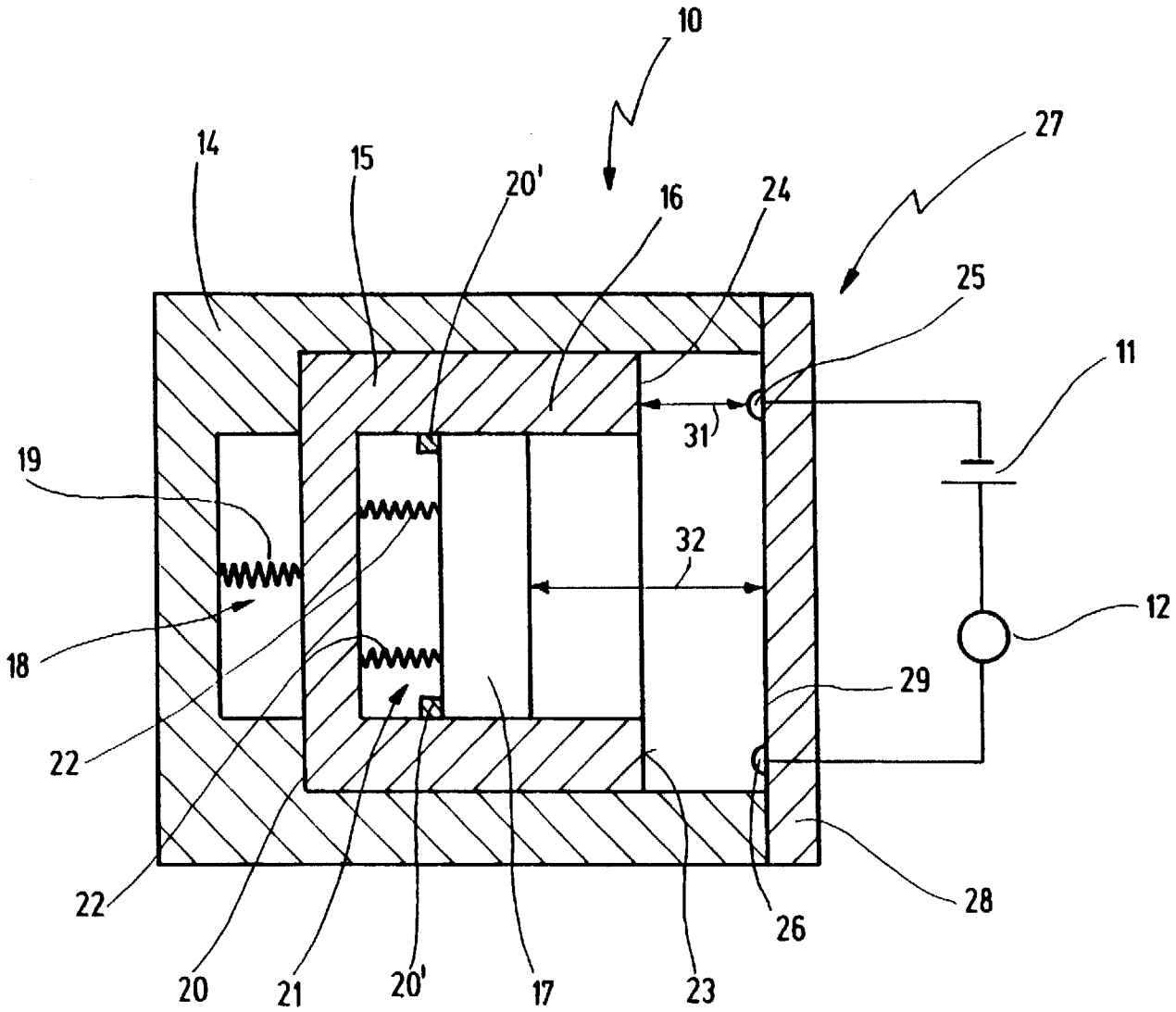
10
11
12
14
15
16
17
18
19
20
20'
20'
21
22
22
23
24
25
26
27
28
29
31
32

SWITCH

FIELD OF THE INVENTION

1. Background of the Invention

The present invention relates to a switch with a mass which moves along a path between a neutral position or so called home position and at least one switching position, at least a first restoration or reset element which prestresses the mass in its neutral or rest position, and a switching contact activated by the mass.

Such constructions are known from switches which are used, for example, as inertia sensors.

Two requirements are in general placed on switches, one relates to the closing force and the other the minimum make time. In the case of the closing force, it is required that this be independent of the actuation force to ensure that the switch closes safely, irrespective of the size of the force exerted to actuate the switch. For this purpose, press-over/snap-over mechanisms are provided, whereby a snap spring snaps over from its home position into its switching position when a minimum actuation force is exceeded, and hereby activates the switching contact for a defined time with a defined force. This minimum actuation force is often defined by a switch spring.

This mechanism simultaneously fulfils the second requirement, the switch remains closed for a minimum make time, during which it does not bounce.

2. Related Prior Art

Such switches are of a complicated design, whereby the minimum actuation force often cannot be precisely adjusted. The mechanism provided for the press-over function, namely, on the one hand displays its own tolerance, and on the other has a retroactive effect on the switch spring, so that the tolerances are added together and a greater uncertainty has to be accepted at the minimum actuation force.

In the sensors mentioned at the outset, such press-over/snap-over mechanisms are not provided, the mass hereby switches the switching contact itself. For this purpose, the mass, for example, is of an electrically conductive design and, in its switching position, makes contact with two electrically conductive surfaces which it bridges and thus short-circuits or activates the switch. The switching process is hereby triggered by the weight and/or inertia of the mass, so that the mass itself has to fulfil a number of tasks.

On the one hand, the switching force and make time can be adjusted by the choice of mass and the properties of the reset element, whereby on the other hand the switching function is brought about by the geometry and/or material properties of the mass. This link between the most important properties of a switch, namely the response threshold, the make time and the safe closing function, and the mass, mean that the manufacturing work and production costs of the known switch are very high.

Since such switches are also used in applications where pulse-like exertions of force and/or accelerations occur, the contact bounce also has to be taken into consideration. Such a contact bounce can occur in the inertia sensors mentioned at the outset if the accelerated mass rebounds a number of times from a limit stop on account of the pulse-like accelerations, whereby the minimum make times are then not fulfilled.

SUMMARY OF THE INVENTION

In view of the above, it is an object of the present invention to provide a safely-closing switch with a defined, low switching force and short response time in a constructionally simple and economic manner, whereby preferably one certain minimum make time is to be achieved. Furthermore, the new switch should also function reliably even after long periods of standstill.

This object is achieved in accordance with the invention by the switch mentioned at the outset in that the first reset element displays an actuating part, which actuates the switching contact when the mass moves from its home position towards its at least one switching position against the force of the first reset element.

The object underlying the invention is thus achieved in full. The necessary switching forces and switching times are adjusted independently of one another by the choice of the mass and the properties of the reset element, whereby the safety of the switching is given by the fact that it is not the mass itself, but rather an actuating part independent of this, which performs the switching function. In the new switch, relatively simple masses can now be used, which can display different dimensions and weights depending on the requirement. However, the same actuating part can always be used for every variant of the new switch, so that the overall storage and production costs are significantly reduced.

The new switch can be used as a sensor for position, tilt, inertia, acceleration or as a safety switch, for example in robot engineering. It is common in robot engineering, namely, to affix hoses filled with compressed-air to robots at points where there is a risk of a collision, so that a compressional wave is triggered when contact is made with these hoses, which is in turn detected by a safety switch which then switches the robot off. With the new switch, it is now possible to accelerate the mass via this compressional wave.

All of these applications are very relevant to safety and require that the switch still functions reliably even after a longer period of non-use. For example, it is possible that the safety switch is not needed over longer periods of operation of the robot, but that near the end of the robot's service life a dangerous situation arises in which humans may even be endangered. Since the contact making in the new switch is now decoupled from the mass itself, a safe switching is ensured. And since, on the other hand, the complicated snap-over/press-over mechanism is avoided, there is no retroactive effect on the actuation force so that the switching threshold does not shift noticeably on account of ageing during the service life of the new switch.

It is then preferred if the actuating part is electrically conductive and if the switching contact comprises two separate contact pads with which the actuating part makes contact when the mass is in its switching position, so that these are electrically connected.

This measure has a constructional advantage since the switching contact is actuated in an, as such, familiar and simple manner. The same actuating part can also be used for different variants of the new switch, so that only one part which has been coated with an electrical contact layer is needed for various types of switch. This significantly reduces the overall storage and production costs.

Greater care can also be taken during coating of the actuating part since the overall costs of the new switch, compared with known switches, are much lower, so that on the whole, a much improved switching safety can be achieved.

It is then preferred if a further reset element is provided which is linked to the first reset element and arranged in such a way that when the actuating part makes contact with the switching contact, it retroactively counteracts a further movement of the mass into at least a second switching position.

The advantage of this measure is that the construction permits very simple debouncing of the new switch and an adjustable minimum make time. The new switch remains closed as long as the mass moves between its first and second switching position against the force of the second reset element. The new switch is closed as soon as the actuating part makes contact with the switching contact, and remains closed whilst the mass moves towards its second switching position. A so-called dwell or closing time duration path is determined by the reset force of the further reset element and the distance between the first and second switching positions in connection with the given mass, which results in the minimum make time.

A further advantage of this arrangement is that the new switch is de-bounced by the aforementioned measure. It is now no longer the mass which makes contact with a stop, rather, the mass continues to move after the actuating part makes contact with the switching contact, provided the actuation force was large enough. In a number of application cases, however, this is always the case, which is why the new switch is not provided with a press-over/snap-over.

It is then preferred if the further reset element is designed more rigidly than the first reset element.

In this simple manner, the minimum actuating force and minimum make time can be separately adjusted. The minimum force or minimum acceleration needed for the actuating part to make contact with the switching contact is determined by the softer, first reset element. Since the second reset element is more rigid, it is not yet moved during this first switching phase. After switching, the mass then continues to move against the force of the second reset element, which determines the minimum make time.

It is then preferred if a limit stop for the first reset element and a further limit stop for the additional reset element are provided, whereby the limit stop for the first reset element is preferably formed by the switching contact.

The advantage of this is that both reset elements are only allowed one specific excursion, so that the switching parameters of the new switch can be exactly adjusted. Moreover, the reset elements are protected against overstretching by the limit stops.

It is further preferred if the mass is a mass with a restricted guidance along the path.

This, as such, known measure leads to the further advantage that only the forces/force components along the restricted guidance path lead to a closure of the new switch, so that this simple construction creates a switch with directional response which can be used, for example, as a sensor for position, tilt, etc. The effective force in such a case is brought about by the dead weight of the mass, which extends the reset element due to gravity when the switch is tilted.

It is hereby preferred if the reset element is a spring element, whereby preferably tension springs and/or compression springs are used.

Although it would also be possible to work with gas pressure in the manner of a shock absorber as a reset element, the use of spring elements has the advantage that the stiffnesses can be easily pre-selected and adjusted. The question as to whether tension or compression springs are used is simply a question of kinematic reversal, and thus the selected special construction in each respective case.

Further advantages can be derived from the description and enclosed drawing.

It is understood that the aforementioned features and those to be explained in the following can be used not only in the specified combinations but also in other combinations or alone without going beyond the scope of the present invention.

BRIEF DESCRIPTION OF THE DRAWING

The drawing shows one embodiment of the invention which will be explained in more detail in the following description.

The single FIGURE shows a schematic, longitudinal section through the new switch.

DESCRIPTION OF A PREFERRED EMBODIMENT

In the FIGURE, 10 indicates the new switch, which in this case is used to optionally connect a battery 11 to a consumer 12.

The switch 10 displays a casing 14 in which a rotationally symmetrical actuating part 15 is arranged which is borne in a manner that it can perform a linear movement, in FIG. 1 this movement being to the right. The inside of the actuating part 15 is a guide tube 16 for a mass 17, which in FIG. 1 is also borne in a manner that it can perform a linear movement and move to the right.

A first reset element 18 in the form of a tension spring 19 is provided between the casing 14 and the actuating part 15, which pulls the actuating part 15 in FIG. 1 to the left against a shoulder 20.

A further reset element 21 is arranged in the guide tube 16, which is here made up of two tension springs 22. The tension springs 22 are provided between the actuating part 15 and the mass 17 so that they prestress the mass 17 in FIG. 1 to the left against stops 20'.

The construction is such that the further reset element 21 is more rigid than the first reset element 18.

If the mass 17 in the FIGURE is now moved to the right through an acceleration, gravity or, for example, compressed air, the tension spring 19 initially extends until the end surface 23 of the actuating part 15, which in the case shown here is an electrically conductive surface 24, makes contact with contact pads 25, 26. These contact pads 25, 26 form a switching contact 27 which is arranged on the cover 28 of the casing 14. As soon as the electrically conductive area 24 comes into contact with the contact pads 25, 26, it closes the switching contact 27 so that the consumer 12 is now connected to the battery 11.

Whilst the actuating part 15 now rests against its stop, the mass 17 in FIG. 1 continues to move to the right, whereby the tension springs 22 now expand. Since these tension springs 22 together display a larger stiffness than the tension spring 19, the tension springs 22 have not yet expanded during the expansion of tension spring 19. The mass 17 now continues to move until it reaches the cover 28, which thus serves as a stop 29 for the mass 17.

Whereas the actuating part 15 has to make a contact travel, indicated by 31, before the new switch 10 switches, the path which the mass 17 has to travel is indicated by 32. It can be seen that after the new switch 10 has switched, the mass travels a so-called dwell path, resulting from the difference between 31 and 32.

Through a suitable choice of stiffness for the tension springs 19 and 22 and size of the mass 17, as well as the mass of the actuating part 15, it can now be ensured that the new switch 10 on the one hand switches safely at a sufficiently high actuating force, and on the other does not bounce. The mass 17, which in FIG. 1 continues to move to the right, prevents the actuating part 15 from rebounding after it makes contact with the contact pads 25, 26, if, for example, the forces which lead to the switching are pulse-like. These pulse-like movements are, on the contrary, absorbed by the further reset element 21 and the mass 17.

Through the series connection of a weaker reset element 18 with a stronger reset element 21, both of which are arranged between the casing 14 and mass 17, the response threshold and minimum make time of the new switch 10 can now be adjusted separately.

It is, of course, possible to design the actuating part 15, shown only schematically in FIG. 1, directly on the tension spring 19 and to guide the mass 17 directly in the casing 14.

All that is important is that the switching contact 27 is closed by the actuating part 15 and not by the mass 17, which in this case only serves to convert the forces which trigger the switching into a movement of the actuating part 15. The further reset element 21 and the increased travel 32 of the mass 17 compared to the contact travel 31, enable a simple determination of the minimum make time, which is achieved without the new switch 10 bouncing due to pulsed shocks, elastic shock, etc.

What I claim is:

1. A switching device, comprising a material mass, said material mass movable along a path between a home position and an end position, a first reset element, said reset element exerting a force preloading said material mass in its home position, and including an actuating part, a switching contact activated by said actuating part when said material mass is moving from its home position towards its end position against said force of said first reset element, and a further reset element linked to said first reset element and arranged such that it restoringly counteracts a further movement of said material mass towards said end position when said switching contact is activated by said actuating part.

2. Switching device according to claim 1, wherein said actuating part comprises electrically conductive material and said switching contact comprises two distinct contact pads spaced apart from each other, said actuating part coming into contact with said contact pads such that the latter are electrically connected together, when said material mass is in its switching position.

3. Switching device according to claim 2, wherein said further reset element counteracts a further movement of said material mass towards said end position when said actuating part is in contact with said contact pads.

4. Switching device according to claim 3, wherein said further reset element is designed more rigidly than said first reset element.

5. Switching device according to claim 3, wherein a limit stop for said first reset element and a further limit stop for said additional reset element are provided.

6. Switching device according to claim 5, wherein said limit stop for said first reset element is formed by said switching contact.

7. Switching device according to claim 1, wherein for said material mass there is provided a restricted linear guidance along said path.

8. Switching device according to claim 1, wherein said reset element is a spring element.

9. Switching device according to claim 1, wherein said first reset element is a tension spring.

10. Switching device according to claim 1, wherein said first reset element is a compression spring.

11. Switching device according to claim 3, wherein said further reset element is a tension spring.

12. Switching device according to claim 3, wherein said further reset element is a compression spring.

* * * * *

UNITED STATES PATENT AND TRADEMARK OFFICE

CERTIFICATE OF CORRECTION

PATENT NO. : 5,726,403

DATED : March 10, 1998

INVENTOR(S) : Manfred Sondergeld et al.

It is certified that error appears in the above-identified patent and that said Letters Patent is hereby corrected as shown below:

ON THE TITLE PAGE,
insert --Assignee: Gebr. Schmidt Fabrik für Feinmechanik,
St. Georgen, Germany--

Signed and Sealed this

Thirty-first Day of August, 1999

*Attest:*

Q. TODD DICKINSON

*Attesting Officer*

*Acting Commissioner of Patents and Trademarks*